US009517921B2

(12) United States Patent
Stofira et al.

(10) Patent No.: US 9,517,921 B2
(45) Date of Patent: Dec. 13, 2016

(54) MACHINE ROOMLESS HYDRAULIC ELEVATOR SYSTEM

(75) Inventors: John Stofira, Cromwell, CT (US); Frank M. Sansevero, Bolton, CT (US); A. Phillip Winey, East Granby, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 441 days.

(21) Appl. No.: 14/117,860

(22) PCT Filed: May 20, 2011

(86) PCT No.: PCT/US2011/037335

§ 371 (c)(1),
(2), (4) Date: Nov. 15, 2013

(87) PCT Pub. No.: WO2012/161674

PCT Pub. Date: Nov. 29, 2012

(65) Prior Publication Data

US 2014/0216854 A1 Aug. 7, 2014

(51) Int. Cl.
*B66B 1/28* (2006.01)
*B66B 9/04* (2006.01)
(Continued)

(52) U.S. Cl.
CPC ..... *B66B 9/04* (2013.01); *B66B 11/002* (2013.01); *B66B 11/0045* (2013.01); *B66B 11/0415* (2013.01); *B66B 11/0423* (2013.01)

(58) Field of Classification Search
CPC ... B66B 9/04; B66B 11/002; B66B 11/0045; B66B 11/0415; B66B 11/0423
USPC ..... 187/247, 285, 286.293, 296, 297, 287, 187/411, 413
See application file for complete search history.

(56) References Cited

U.S. PATENT DOCUMENTS 5,740,888 A * 4/1998 Aulanko ..... B66B 11/002 187/336
6,039,152 A * 3/2000 Schops ..... B66B 11/002 187/250

(Continued)

FOREIGN PATENT DOCUMENTS

GR WO 03013996 A1 * 2/2003 ..... B66B 9/04
JP 2004250210 A 9/2004

(Continued)

OTHER PUBLICATIONS

International Preliminary Report on Patentability for International application No. PCT/US2011/037335 dated Nov. 28, 2013.

(Continued)

*Primary Examiner* — Anthony Salata
(74) *Attorney, Agent, or Firm* — Carlson, Gaskey & Olds

(57) ABSTRACT

A hydraulic elevator system does not include a machine room but does include an access panel that allows at least a control valve and controller to be accessible from outside of the hoistway while the control valve and controller remain in the hoistway. An exemplary elevator system includes a hoistway. An elevator car is supported within the hoistway. The hydraulic cylinder is associated with the elevator car for selectively moving the elevator car. A reservoir is within the hoistway. The reservoir is configured to contain fluid for selectively causing extension of the cylinder. A control valve within the hoistway controls communication of the fluid between the reservoir and the cylinder. A controller within the hoistway controls movement of the elevator car. An access panel is on one side of the hoistway for selectively closing and opening into the hoistway near the control value and the controller. The opening provides access to at least the control valve and the controller from outside of the hoistway.

17 Claims, 3 Drawing Sheets

(51) Int. Cl.
*B66B 11/00* (2006.01)
*B66B 11/04* (2006.01)

(56) References Cited

U.S. PATENT DOCUMENTS 6,044,933 A * 4/2000 Johansson ..... B66B 9/04 187/272
6,148,962 A * 11/2000 Hakala ..... B66B 11/0045 187/254
6,371,005 B1 4/2002 Foschini et al.
6,378,660 B1 4/2002 Adifon et al.
6,397,975 B1 * 6/2002 Rutten ..... B66B 11/0438 187/266
6,484,850 B1 * 11/2002 Kobayashi ..... B66B 13/303 187/414
6,499,567 B2 12/2002 Foschini et al.
6,896,105 B1 * 5/2005 Yamakawa ..... B66B 11/002 187/254
7,364,019 B2 * 4/2008 Faletto ..... B66B 11/004 187/250
2007/0256898 A1 11/2007 Lee
2009/0114482 A1 * 5/2009 von Holzen ..... B66B 11/0423 187/253
2012/0145489 A1 * 6/2012 Tian ..... B66B 19/005 187/406
2014/0224591 A1 * 8/2014 Garcia ..... B66B 11/0005 187/251

FOREIGN PATENT DOCUMENTS

JP 2006232457 A 9/2006
WO 9964339 12/1999

OTHER PUBLICATIONS

International Search Report and Written Opinion of the International Searching Authority for International application No. PCT/US2011/037335 dated Feb. 17, 2012.

* cited by examiner

MACHINE ROOMLESS HYDRAULIC ELEVATOR SYSTEM

BACKGROUND

Elevator systems have proven useful for carrying passengers between different levels in buildings. Some elevator systems are traction-based and rely upon traction between a traction sheave and a roping arrangement for moving the elevator car. Other elevator systems are hydraulic and utilize a hydraulic fluid for expanding a cylinder to cause upward movement of the elevator car. Releasing the fluid from the cylinder allows the elevator car to descend.

There has been a relatively large amount of activity in the industry for developing and implementing traction-based elevator systems without a machine room Eliminating a machine room from an elevator system provides savings in terms of the amount of building space required by the system. There has been less activity with regard to providing a machine roomless hydraulic elevator system. U.S. Pat. Nos. 6,371,005; 6,378,660; and 6,499,567 show arrangements that allow for eliminating a machine room in a hydraulic elevator system. One challenge associated with a machine roomless hydraulic elevator system is providing the ability to address maintenance and repair issues that may arise over time.

SUMMARY

An exemplary elevator system includes a hoistway. An elevator car is supported within the hoistway. A hydraulic cylinder is associated with the elevator car for selectively moving the elevator car. A reservoir is within the hoistway. The reservoir is configured to contain fluid for selectively causing extension of the cylinder. A control valve within the hoistway controls communication of the fluid between the reservoir and the cylinder. A controller within the hoistway controls movement of the elevator car. An access panel is on one side of the hoistway for selectively closing an opening into the hoistway near the control valve and the controller. The opening provides access to at least the control valve and the controller from outside of the hoistway.

In one example embodiment that includes the elements of the foregoing embodiment, a shutoff valve is included in the hoistway. The shutoff valve is accessible from outside the hoistway through the opening.

In another example embodiment that includes the elements of either of the foregoing embodiments, a pump within the hoistway is associated with the reservoir for selectively pumping fluid from the reservoir to the cylinder. A motor is associated with the pump and positioned at least partially within the reservoir and in contact with some of the fluid in the reservoir. The pump and the motor are at least partially accessible through the opening.

In another example embodiment that includes the elements of any of the foregoing embodiments, a manually operable pump is positioned within the hoistway for manually controlling fluid distribution between the cylinder and the reservoir to control a position of the elevator car. The manually operable pump has an actuator that is accessible through the opening.

In another example embodiment including the elements of any of the foregoing embodiments, the access panel comprises a door.

In another example embodiment that includes the elements of any of the foregoing embodiments, the hoistway includes a pit at a bottom of the hoistway. The opening and the access panel are positioned above the pit.

In another example embodiment that includes the elements of any of the foregoing embodiments, the opening and the access panel are located on one of a plurality of levels along the hoistway.

In another example embodiment that includes the elements of any of the foregoing embodiments, the elevator car includes at least one car door facing a first side of the hoistway. The opening is through a second side of the hoistway that is generally perpendicular to the first side of the hoistway.

In another example embodiment that includes the elements of any of the foregoing embodiments, the elevator car includes at least one car door facing a first side of the hoistway. The opening is through a second side of the hoistway that is opposite to and generally parallel with the first side.

The various features and advantages of this invention will become apparent to those skilled in the art from the following detailed description. The drawings that accompany the detailed description can be briefly described as follows.

DETAILED DESCRIPTION

Figure 1:
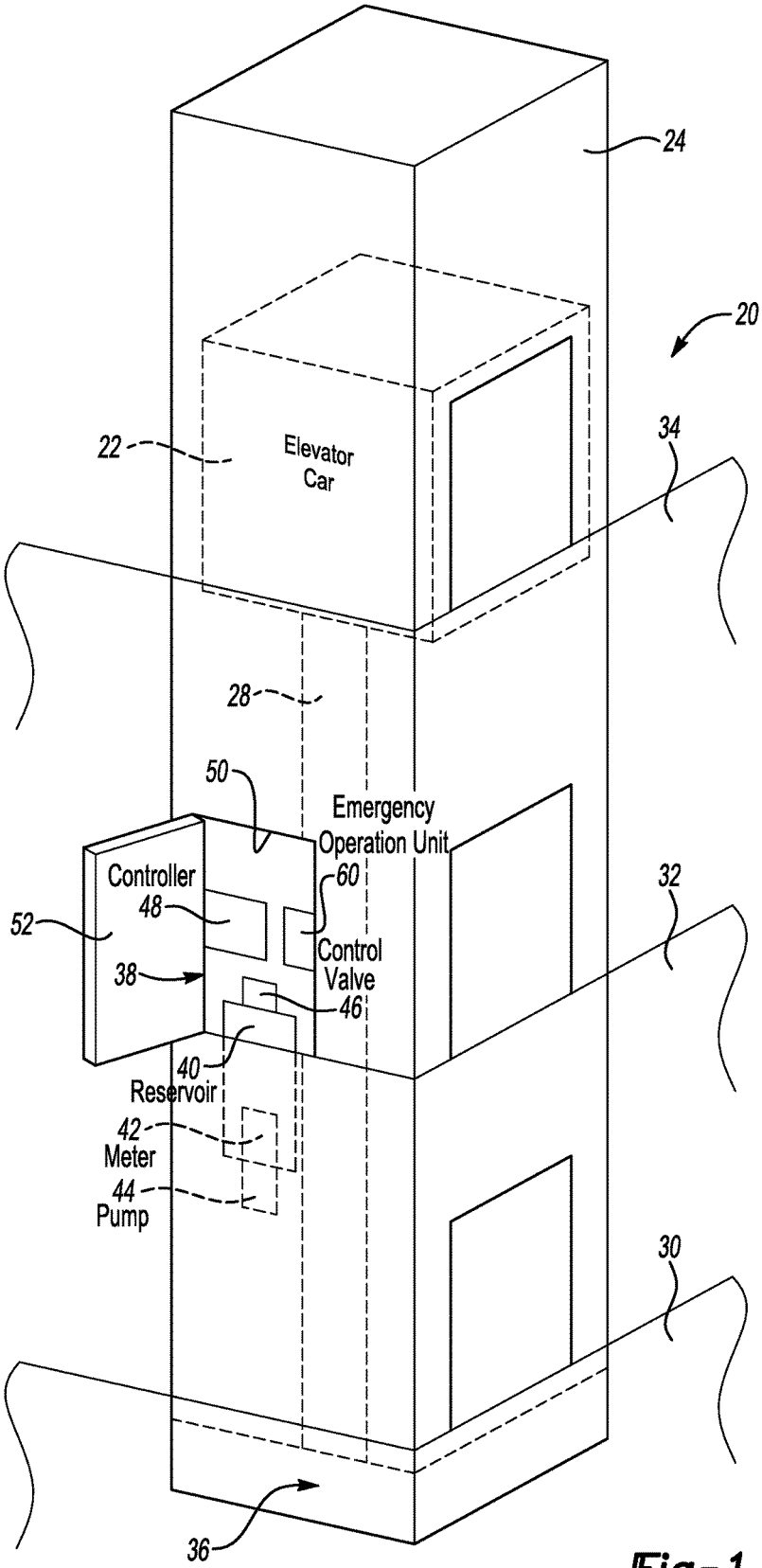
FIG. 1 schematically shows selected portions of an example elevator system designed according to an embodiment of this invention.

FIG. 1 schematically shows selected portions of an elevator system 20. An elevator car 22 is supported within a hoistway 24. The example elevator system 20 is a hydraulic elevator system. A cylinder 28 is associated with the elevator car 22 to selectively cause movement of the elevator car 22 between different levels or floors 30, 32 and 34 along the hoistway 24.

The example hoistway 24 includes a pit 36 near a bottom of the hoistway 24. The example elevator system 20 does not include a machine room. Instead, the elements of a control assembly 38 are all located within the hoistway 24.

Figure 2:
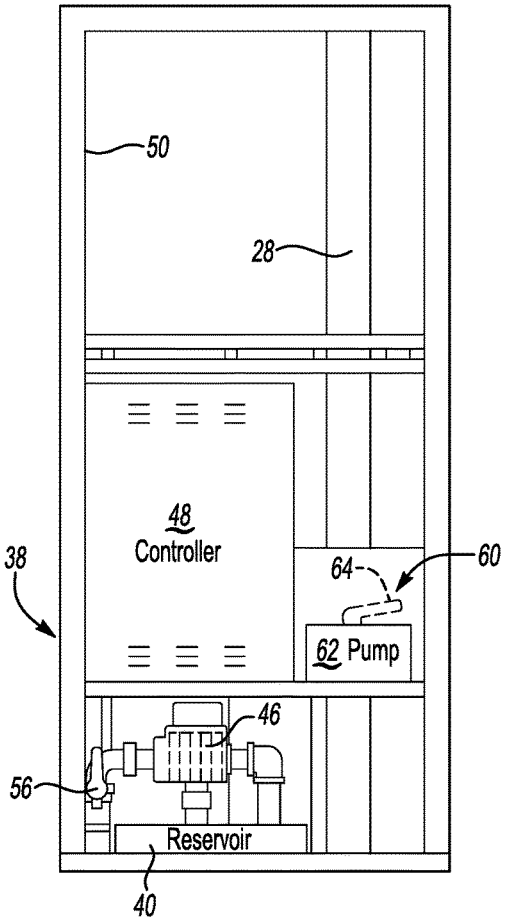
FIG. 2 schematically shows an arrangement of a control assembly and an opening through which elements of the control assembly are accessible.

As can be appreciated from FIGS. 1 and 2, the example control assembly 38 includes a reservoir 40 that contains fluid that is selectively provided to the cylinder 28. As shown, the reservoir 40 may be mounted to a side of the hoistway 24 (e.g., the side 76 in FIG. 4 or the side 78 in FIG. 5). In other embodiments, however, the reservoir 40 may extend down to and be supported by the floor of the pit 36. In one example, the fluid within the reservoir 40 comprises oil. A motor 42 is positioned within the reservoir 40 so that the motor is exposed to at least some of the fluid within the reservoir 40. This provides a cooling function for the motor 42.

The motor 42 drives a pump 44 that is used for supplying pressurized fluid from the reservoir 40 to the cylinder 28. Increasing the amount of fluid in the cylinder 28 causes the elevator car 22 to rise within the hoistway 24. Allowing fluid to return to the reservoir 40 from the cylinder 28 allows the elevator car 22 to descend. The illustrated example includes a control valve 46 that controls communication of fluid between the cylinder 28 and the reservoir 40.

A controller 48 includes electronics that are used for controlling movement and position of the elevator car 22. The electronics of the controller 48 respond to requests for passenger service and provide control over the operation of the valve 46, the motor 42 and pump 44, for example.

At least the control valve 46 and the controller 48 are accessible from outside of the hoistway through an opening 50 in one side of the hoistway 24. In some examples, at least a portion of the motor 42, the pump 44 or both are also accessible through the opening 50. An access panel 52 selectively closes off the opening 50 so that only authorized individuals can obtain access to the portions of the control assembly 38 that are accessible through the opening 50.

As shown in FIG. 2, the illustrated example also includes a shutoff valve 56 for manually cutting off communication of hydraulic fluid between the reservoir 40 and the cylinder 28. The shutoff valve 56 is accessible through the opening 50.

The example of FIG. 2 also includes an emergency operation unit 60 that includes a manual pump 62 for manually controlling a fluid supply to the cylinder 28, for example. An actuator 64 that allows for manual operation of the pump 62 is accessible through the opening 50.

Providing access from outside of the hoistway to portions of the control assembly 38 located within the hoistway 24 insures the ability for an individual 68 (FIG. 3) to be able to access necessary components of the control assembly 38 to address any maintenance or repair issues that may arise. Without the external access through the opening 50, it may have been possible for one or more of the elements of the control assembly 38 to be inaccessible depending on the position of the car 22 at the time of a power outage, for example. With external access provided through the opening 50, the control assembly 38 is always accessible to a mechanic.

Figure 3:
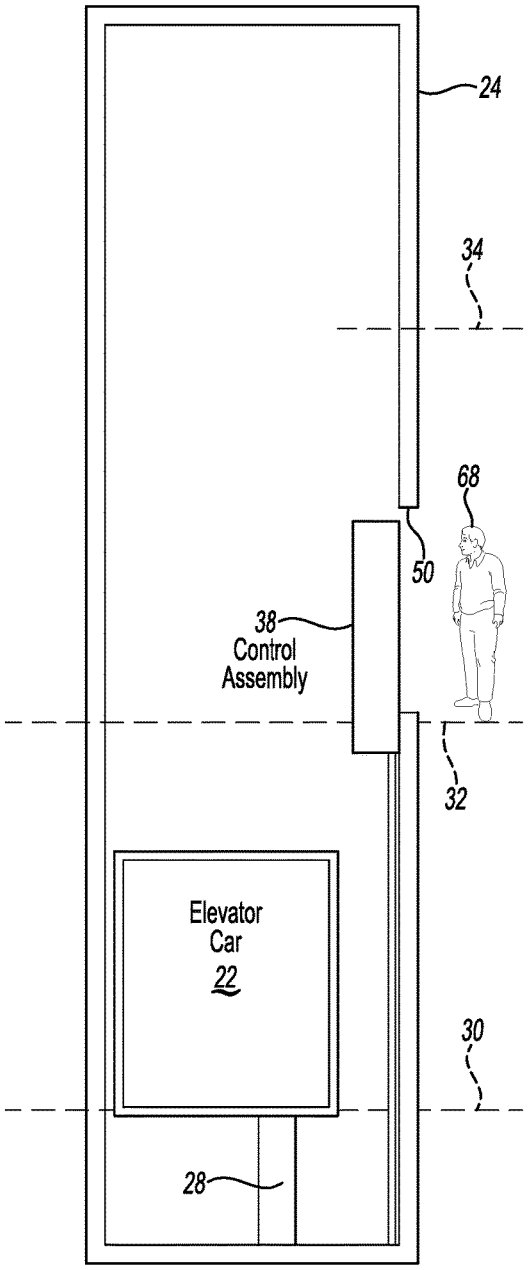
FIG. 3 is a side elevational view schematically showing an arrangement of a control assembly relative to an elevator car within a hoistway.

FIG. 3 shows how the control assembly 38 is positioned within a hoistway 24 in a space between the elevator car 22 and a selected sidewall of the hoistway 24. In FIG. 3, the opening 50 is positioned so that the individual 68 can be standing on the floor level 32 to obtain access to the control assembly 38. In another example, the opening 50 may be positioned so that the individual 68 can be standing on any other floor level 30, 34 and obtain the necessary access to the control assembly 38. The opening 50 preferably is above the pit 36, which is located near the bottom of the hoistway 24.

Figure 4:
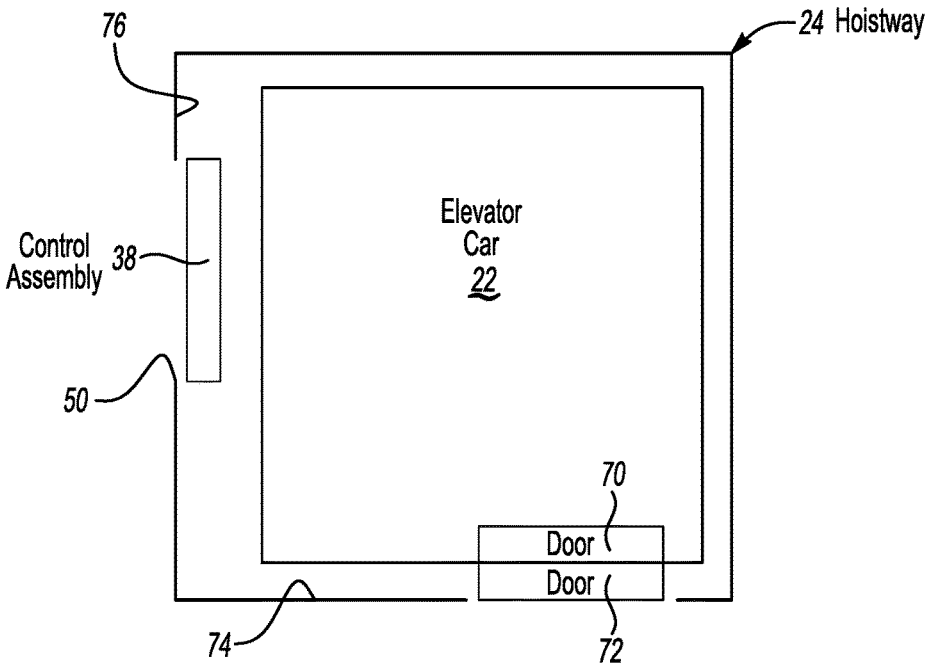
FIG. 4 is a top elevational view showing one position of a control assembly relative to an elevator car within a hoistway.

FIG. 4 illustrates one position of the control assembly 38 relative to the elevator car 22. In this example, the elevator car 22 includes at least one car door 70 that cooperates with a hoistway door 72 to allow passengers to enter or exit the elevator car 22. The car door 70 faces a first side 74 of the hoistway 24. In this example, the opening 50 is provided on a second side 76 of the hoistway 24. The second side 76 is generally perpendicular to the first side 74. If the first side 74 is considered to be facing the front of the elevator car 22, then the second side 76 is considered to be on one side of the elevator car 22 in this example.

Figure 5:
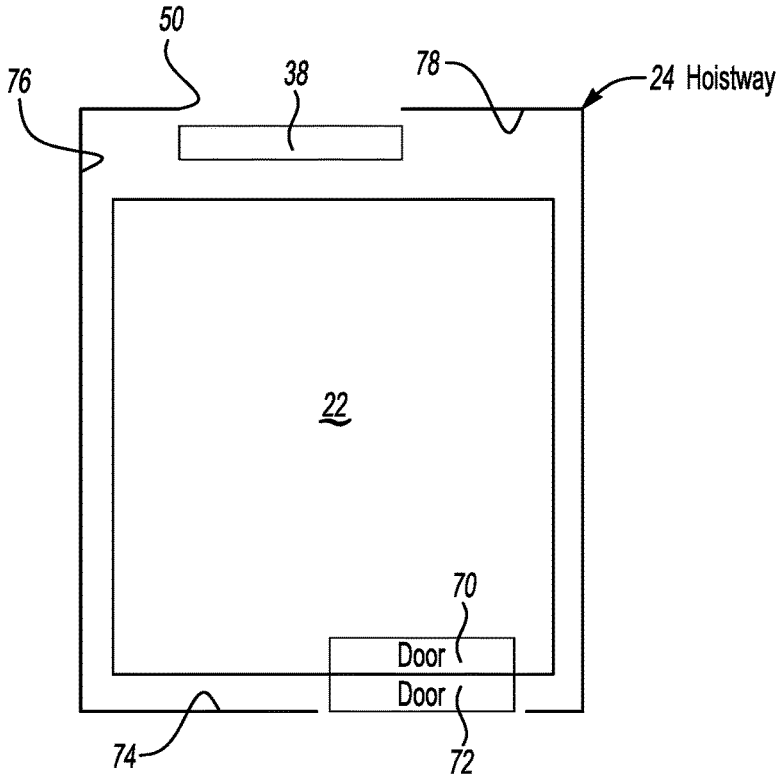
FIG. 5 is a top elevational view showing another position of a control assembly relative to an elevator car within the hoistway.

FIG. 5 shows another placement of the control assembly 38. In this example, the control assembly 38 is between the elevator car 22 and another side 78 of the hoistway 24. The side 78 is opposite the first side 74 and generally parallel to it. If the side 74 is considered to face the front of the elevator car 22, the side 78 is considered the rear side in this example. Depending on the configuration of a building and the manner in which the hoistway is situated in the building, an arrangement as shown in FIG. 4 or 5 may be used.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a hoistway;

an elevator car supported within the hoistway;

a hydraulic cylinder associated with the elevator car for selectively moving the elevator car;

a reservoir within the hoistway, the reservoir being configured to contain fluid for selectively causing extension of the cylinder;

a control valve within the hoistway, the control valve controlling communication of the fluid between the reservoir and the cylinder;

a controller within the hoistway for controlling movement of the elevator car;

an access panel on one side of the hoistway for selectively closing an opening into the hoistway near the control valve and the controller, the opening providing access to at least the control valve and the controller from outside of the hoistway wherein the control valve and controller remain in the hoistway while being accessed through the access panel.

2. The elevator system of claim 1, comprising a shut off valve in the hoistway, wherein the shutoff valve is accessible from outside the hoistway through the opening.

3. The elevator system of claim 1, comprising a pump within the hoistway and associated with the reservoir and the motor for selectively pumping fluid from the reservoir to the cylinder;

a motor associated with the pump and positioned at least partially within the reservoir and in contact with some of the fluid in the reservoir;

wherein the pump and the motor are at least partially accessible through the opening.

4. The elevator system of claim 1, comprising a manually operable pump positioned within the hoistway for manually controlling fluid distribution between the cylinder and the reservoir to control a position of the elevator car, wherein the manually operable pump has an actuator that is accessible through the opening.

5. The elevator system of claim 1, wherein the access panel comprises a door.

6. The elevator system of claim 1, wherein the hoistway includes a pit at a bottom of the hoistway and wherein the opening and the access panel are positioned above the pit.

7. The elevator system of claim 1, wherein the opening and the access panel are located on one of a plurality of levels along the hoistway.

8. The elevator system of claim 1, wherein the elevator car includes at least one car door facing a first side of the hoistway and the opening is through a second side of the hoistway that is generally perpendicular to the first side of the hoistway.

9. The elevator system of claim 1, wherein the elevator car includes at least one car door facing a first side of the hoistway and the opening is through a second side of the hoistway that is opposite to and generally parallel with the first side.

10. An elevator system, comprising:

a hoistway;

an elevator car supported within the hoistway;

a hydraulic cylinder associated with the elevator car for selectively moving the elevator car;

a reservoir within the hoistway, the reservoir being configured to contain fluid for selectively causing extension of the cylinder;

a pump within the hoistway and associated with the reservoir for selectively pumping fluid from the reservoir to the cylinder;

a motor associated with the pump and positioned at least partially within the reservoir and in contact with some of the fluid in the reservoir;

a control valve within the hoistway, the control valve controlling communication of the fluid between the reservoir and the cylinder;

a controller within the hoistway for controlling movement of the elevator car;

an access panel on one side of the hoistway for selectively closing an opening into the hoistway near the control valve and the controller, the opening providing access to at least the control valve and the controller from outside of the hoistway and wherein the pump and the motor are at least partially accessible through the opening.

11. The elevator system of claim 1, comprising a shut off valve in the hoistway, wherein the shutoff valve is accessible from outside the hoistway through the opening.

12. The elevator system of claim 1, comprising a manually operable pump positioned within the hoistway for manually controlling fluid distribution between the cylinder and the reservoir to control a position of the elevator car, wherein the manually operable pump has an actuator that is accessible through the opening.

13. The elevator system of claim 1, wherein the access panel comprises a door.

14. The elevator system of claim 1, wherein the hoistway includes a pit at a bottom of the hoistway and wherein the opening and the access panel are positioned above the pit.

15. The elevator system of claim 1, wherein the opening and the access panel are located on one of a plurality of levels along the hoistway.

16. The elevator system of claim 1, wherein the elevator car includes at least one car door facing a first side of the hoistway and the opening is through a second side of the hoistway that is generally perpendicular to the first side of the hoistway.

17. The elevator system of claim 1, wherein the elevator car includes at least one car door facing a first side of the hoistway and the opening is through a second side of the hoistway that is opposite to and generally parallel with the first side.

* * * * *